US009332832B2

(12) United States Patent
Deyon

(10) Patent No.: US 9,332,832 B2
(45) Date of Patent: May 10, 2016

(54) DECORATIVE KITCHEN SINK STORAGE DEVICE

(71) Applicant: Bradford Deyon, Houston, TX (US)

(72) Inventor: Bradford Deyon, Houston, TX (US)

( * ) Notice: Subject to any disclaimer, the term of this patent is extended or adjusted under 35 U.S.C. 154(b) by 422 days.

(21) Appl. No.: 13/857,161

(22) Filed: Apr. 5, 2013

(65) Prior Publication Data

US 2014/0299496 A1 Oct. 9, 2014

(51) Int. Cl.

| | |
|---|---|
| ***A47K 10/00*** | (2006.01) |
| ***A46B 17/00*** | (2006.01) |
| ***A47L 13/51*** | (2006.01) |
| ***A47L 17/08*** | (2006.01) |

(52) U.S. Cl.

CPC ..... *A46B 17/00* (2013.01); *A47L 13/51* (2013.01); *A47L 17/08* (2013.01)

(58) Field of Classification Search

CPC ..... A46B 17/00; A47L 17/08; A47L 13/51
USPC ..... 211/13.1, 16, 41.3, 45, 85.12, 85.25, 211/88.04, 105.1, 119.005; 206/349, 361, 206/553

See application file for complete search history.

(56) References Cited

U.S. PATENT DOCUMENTS

| | | | | | |
|---|---|---|---|---|---|
| 2,175,753 | A * | 10/1939 | Guthmann | 211/85.12 |
| D154,903 | S * | 8/1949 | Caldwell | D6/536 |
| 5,180,067 | A * | 1/1993 | Conaway et al. | 211/16 |
| 6,257,425 | B1 * | 7/2001 | Liu | 211/16 |
| 6,920,989 | B2 * | 7/2005 | Lin | 211/87.01 |
| 8,162,158 | B2 * | 4/2012 | Northrup et al. | 211/90.02 |
| 8,783,474 | B2 * | 7/2014 | Kuhlman | 211/90.02 |
| 2007/0125723 | A1 * | 6/2007 | Rockel | 211/16 |
| 2009/0090682 | A1 * | 4/2009 | Bushey et al. | 211/45 |

* cited by examiner

*Primary Examiner* — Luan K Bui
(74) *Attorney, Agent, or Firm* — Norris & Norris

(57) ABSTRACT

A dish cloth holder, which includes decorative covers to use as a display for the room while the dish cloth and other sink items are able to dry more effectively within.

20 Claims, 11 Drawing Sheets

DECORATIVE KITCHEN SINK STORAGE DEVICE

CROSS REFERENCE TO RELATED APPLICATION

This non-provisional patent application claims priority and the benefit under 35 U.S.C. §119(e) of the U.S. Provisional Application Ser. No. 61/620,450, entitled "Decorative Dish Cloth Holder," filed Apr. 5, 2012, all of which is herein incorporated by reference.

BACKGROUND OF THE INVENTION

1. Field of the Invention

The present invention is related to a dish cloth holder, and specifically to a dish cloth holder with a decorative enclosing, which removes the dish cloth and other sink items from view, while allowing them to dry.

2. Description of the Related Art

In many homes it is common to allow a dish cloth or sponge to dry by placing them on the sink This creates an unpleasant decor in the kitchen, since many people do not always buy kitchen towels to match the color or style of the kitchen. Additionally, since dish cloths and sponges typically lay flat on the sinks surface, they dry slower than they would if they were hung since lying flat does not allow air to pass through from a variety of angles.

Some homes have towel racks, either on the wall or on the counter that can be used to hang the cloth on. This allows the cloths to dry more efficiently, since it allows air to pass through from a variety of angles, but these still leave the cloth exposed in the kitchen when it is not in use. Also, when the rack is mounted on the wall, moving the rack leaves unsightly marks when people rearrange or redecorate.

The need exists for a towel holder that can both stow the dish cloth and other sink items away from view, while allowing them to dry more efficiently.

OBJECTIVE OF THE INVENTION

The main objective of the invention is to provide a holder for a dish cloth and other sink items to dry more effectively thereupon, while using a decorative enclosure for display in the kitchen which removes the items from view.

SUMMARY OF THE INVENTION

The invention for achieving the aforementioned objects is a holder capable of holding a dish cloth and other sink items, including but not limited to sponges, strainers, stoppers and/or soap dispensers behind a decorative enclosure while allowing them to dry more effectively. The present invention is a towel holder that can both stow the dish cloth and other sink items away from view, while allowing them to dry more efficiently and allows the room to have better decor, through the use of a decorative enclosure. This enclosure can be used to also remove other items like strainers, stoppers and soap dispensers. It can also come in a variety of colors to better blend in with the colors and style of the room.

DESCRIPTION OF THE PREFERRED EMBODIMENT

Embodiments of the present invention are now explained. Although the disclosure is sufficient to enable to those skilled in the art to practice the invention, the physical embodiments herein disclosed merely exemplify the invention, which may be embodied in other structures and/or designs. While the preferred embodiment has been described, the details may be changed without departing from the invention.

Figure 1:
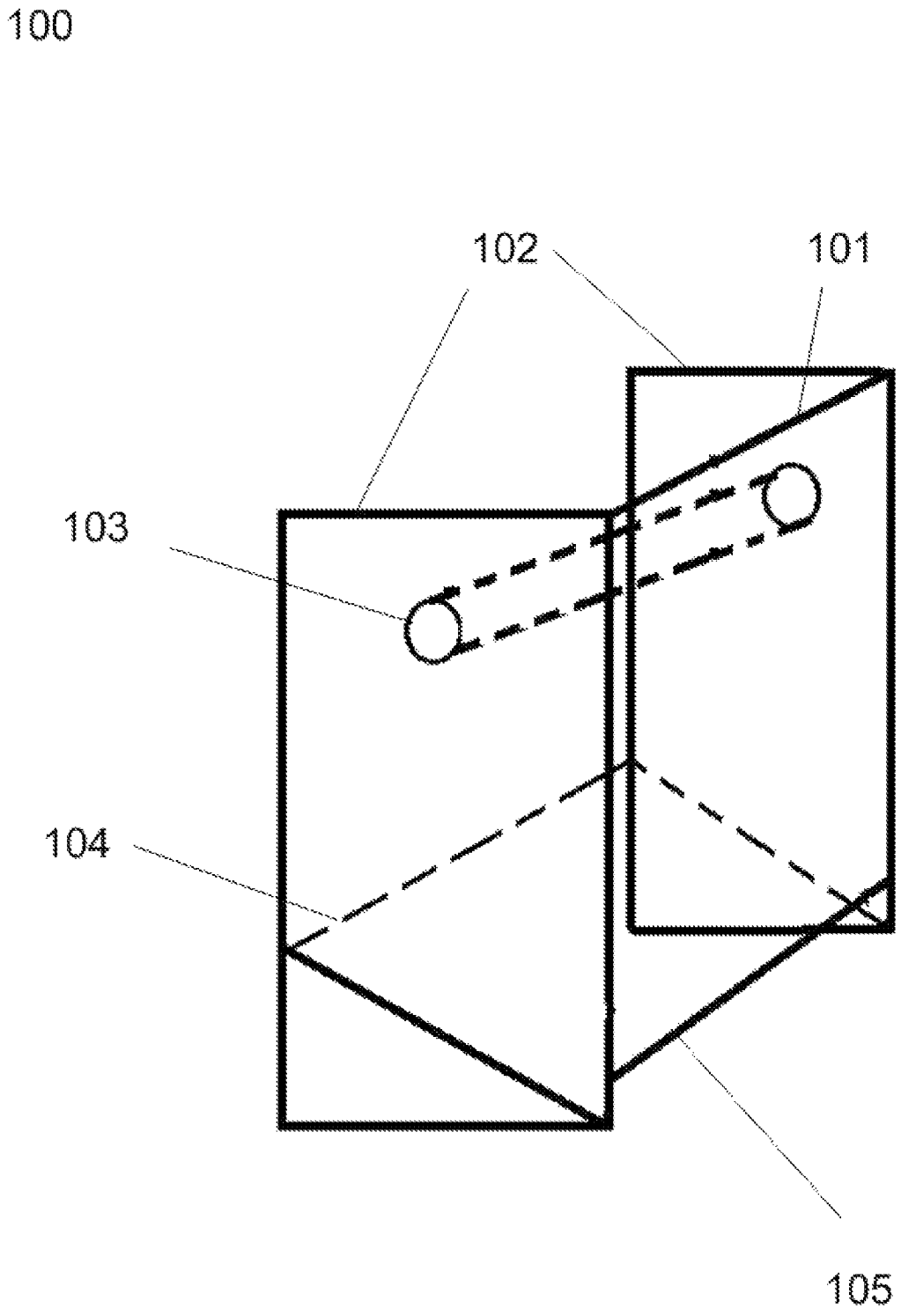
FIG. 1 shows a view of the backless holder from the side, including the interior.

FIG. 1 illustrates the holder 100 from the side. The holder contains a front cover 101 and two side covers 102. The interior of the holder is designated with dashed lines. The rod 103, from which dish cloths can be hung, is designated as a cylindrical dashed line near the top of the holder. Near the bottom of the holder, dashed lines are used to illustrate a panel 104 where the excess liquid, such as water, can drain from the bottom of the front cover 105 into the sink. This panel 104 can also be used to hold sink items, like sponges. It will be understood by one of ordinary skill in the art that while one cylindrical rod 103 is shown, the holder can contain multiple rods, which may have different shapes, like a square or block rod(s) and may contain other advantages like holes in the rod(s) to enable better drainage and drying of a cloth hanging there from.

Figure 2:
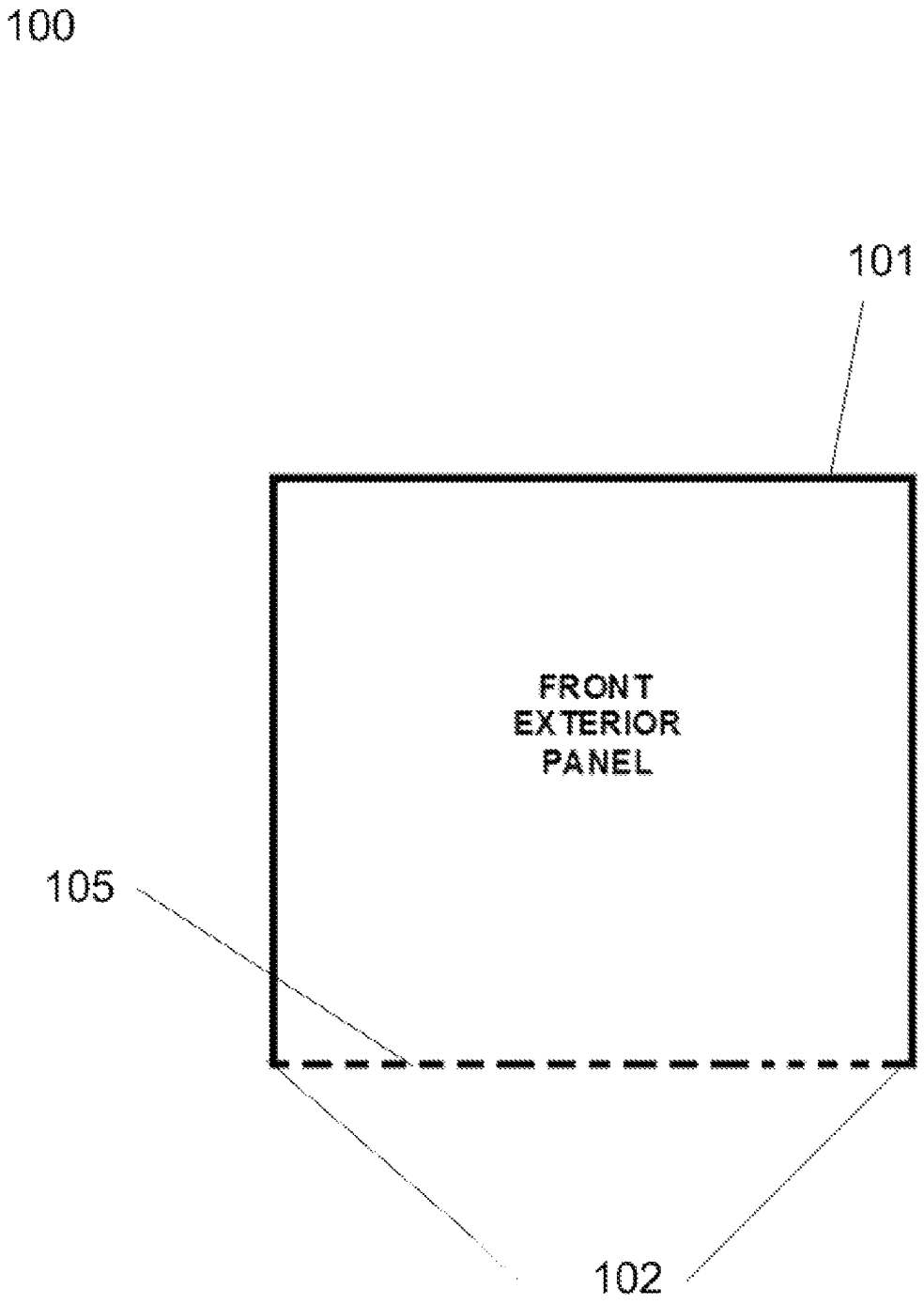
FIG. 2 shows a view of the backless holder from the front.

FIG. 2 illustrates the frontal view of the holder 100. Esthetically pleasing decorations and attributes of the front cover 101 can is displayed from this view of the holder 100. The dashed lines 105 at the bottom represent an opening for the excess liquid to drain out to the bottom of the holder and out to a sink or external drain.

Figure 3:
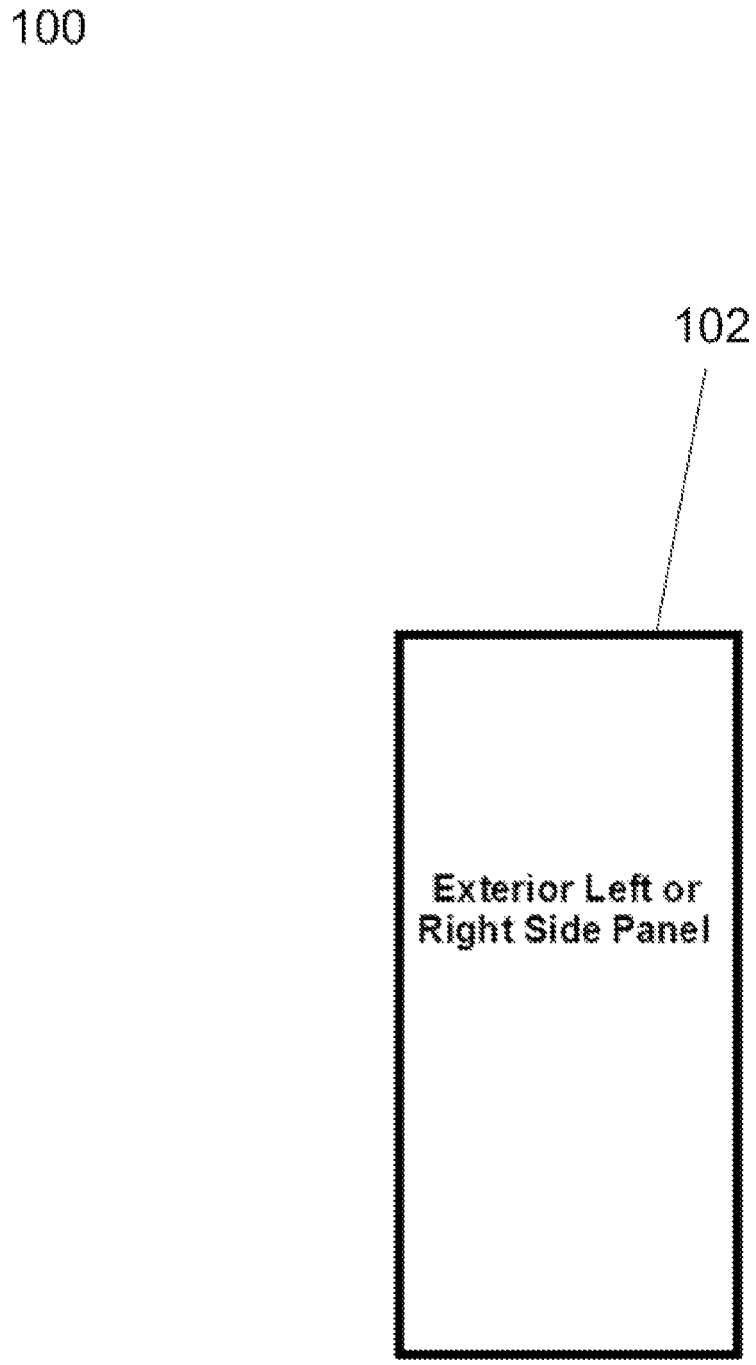
FIG. 3 shows a view of the backless holder from the side.

FIG. 3 illustrates a side view of the holder 100. It consists entirely of the side cover 102. Like the front cover 101, esthetically pleasing decorations and attributes of the side cover 102 can also displayed from this view of the holder 100. Such esthetically pleasing decorations and attributes of the front cover 101 and side cover 102 can be displayed to better suit the decor of a room, such as a kitchen.

Figure 4:
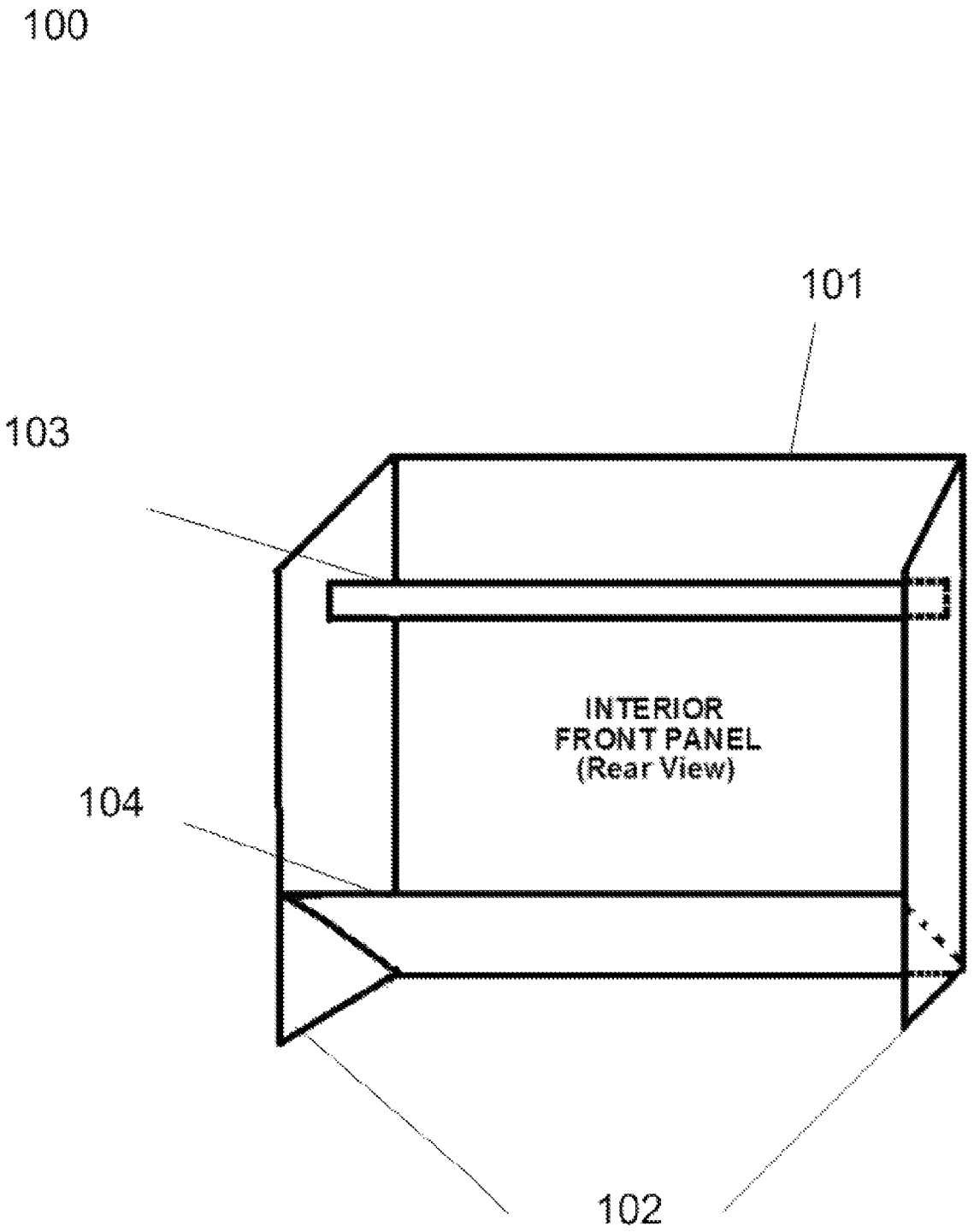
FIG. 4 shows a view of the backless holder from the rear.

FIG. 4 illustrates the rear view of holder 100. The rod 103 to hold the dish cloth, is connected to and between the two side covers 102. The drain panel 104 is situated at an angle within the holder. This angle may be adjusted for desired draining parameters. This rear open area of the holder 100 can be situated to face a wall or unseen area, keeping the draining articles out of the view of open areas of a room, such as a kitchen.

Figure 5:
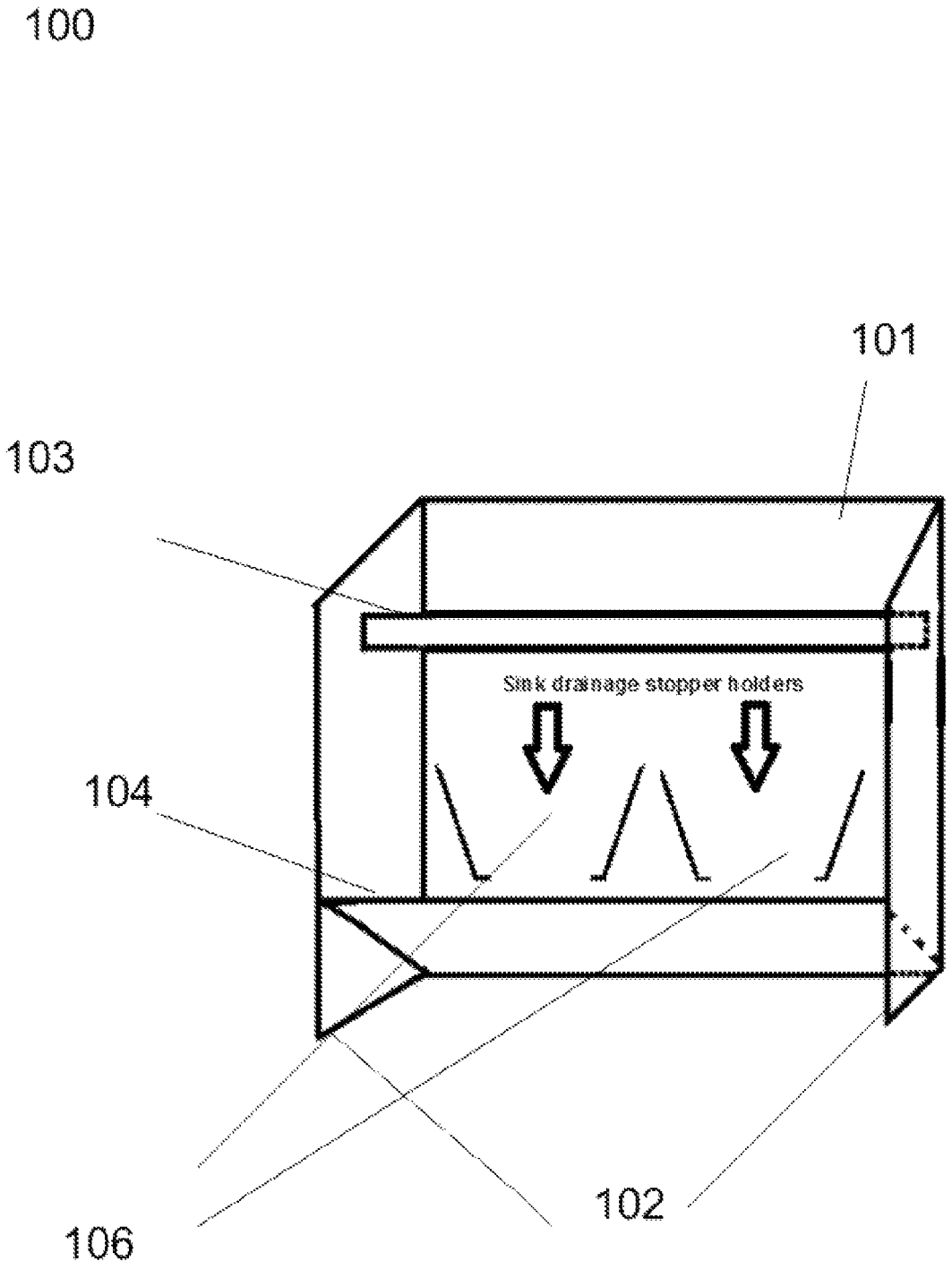
FIG. 5 shows a view of the backless holder from the rear with two partitioned sections designated for holding other sink items.

FIG. 5 illustrates an embodiment of the rear view of holder 100, and also shows two partitioned sections 106, which can be used for holding other items for drainage and drying. The rod 103, is again connected between the two side covers 102. The drain panel 104 is shown at an angle at the bottom of the holder 100. This angle may be adjustable for desired draining parameters. The partitioned sections 106, are located on the back of the front cover 101 inside the holder 100. These partitioned sections could also be placed inside the side covers 102 in addition or in place of the front cover 101.

Figure 6:
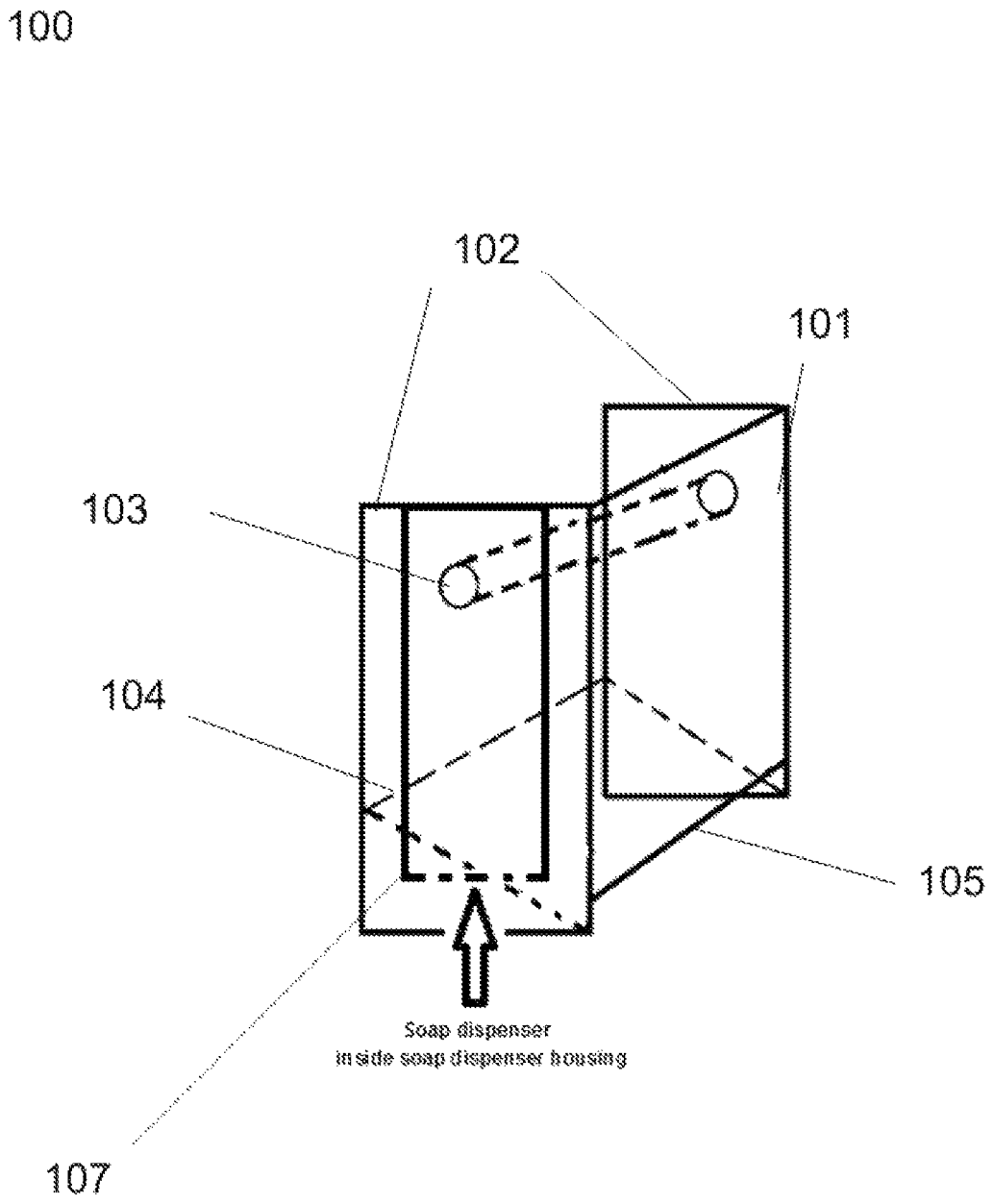
FIG. 6 shows a view of the backless holder from the side with a soap dispenser housing.

FIG. 6 illustrates an embodiment of the holder 100, which also contains a housing for dispensing a substance, such as hand soap or dishwashing soap or liquid 107, from the side. The holder 100 contains a front cover 101 and two side covers 102. The rod 103 from, which dish cloths can be hung, is placed between the two side covers 102 and is designated as a cylindrical dashed line near the top of the holder. Near the bottom of the holder dashed lines are used to illustrate a panel 104 where the excess water can drain under the bottom of the front cover 105 into the sink. In this embodiment, the liquid dispenser housing 107 is located on the side of the holder 100, but this design may be modified to for functional purposes and décor.

Figure 7:
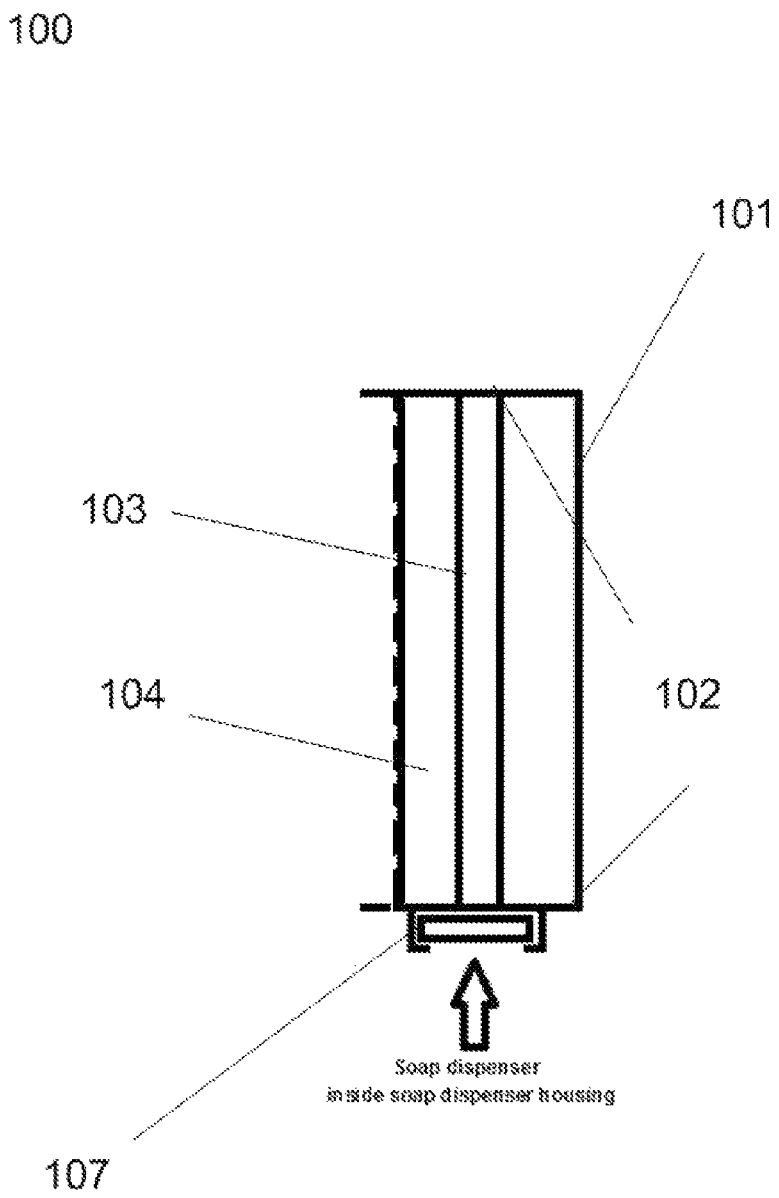
FIG. 7 shows a view of the backless holder from the top with a soap dispenser housing.

FIG. 7 illustrates an embodiment of the holder 100, which also contains a dispenser housing 107, from the top. The holder contains a front cover 101 and two side covers 102. The rod 103 from, which dish cloths can be hung, is placed between the two side covers 102 and is shown as a rectangular line in the middle of the holder 100. On the left of the holder 100 panel 104 is shown where the excess water can drain. At the bottom of the holder 100 is dispenser housing 107.

Figure 8:
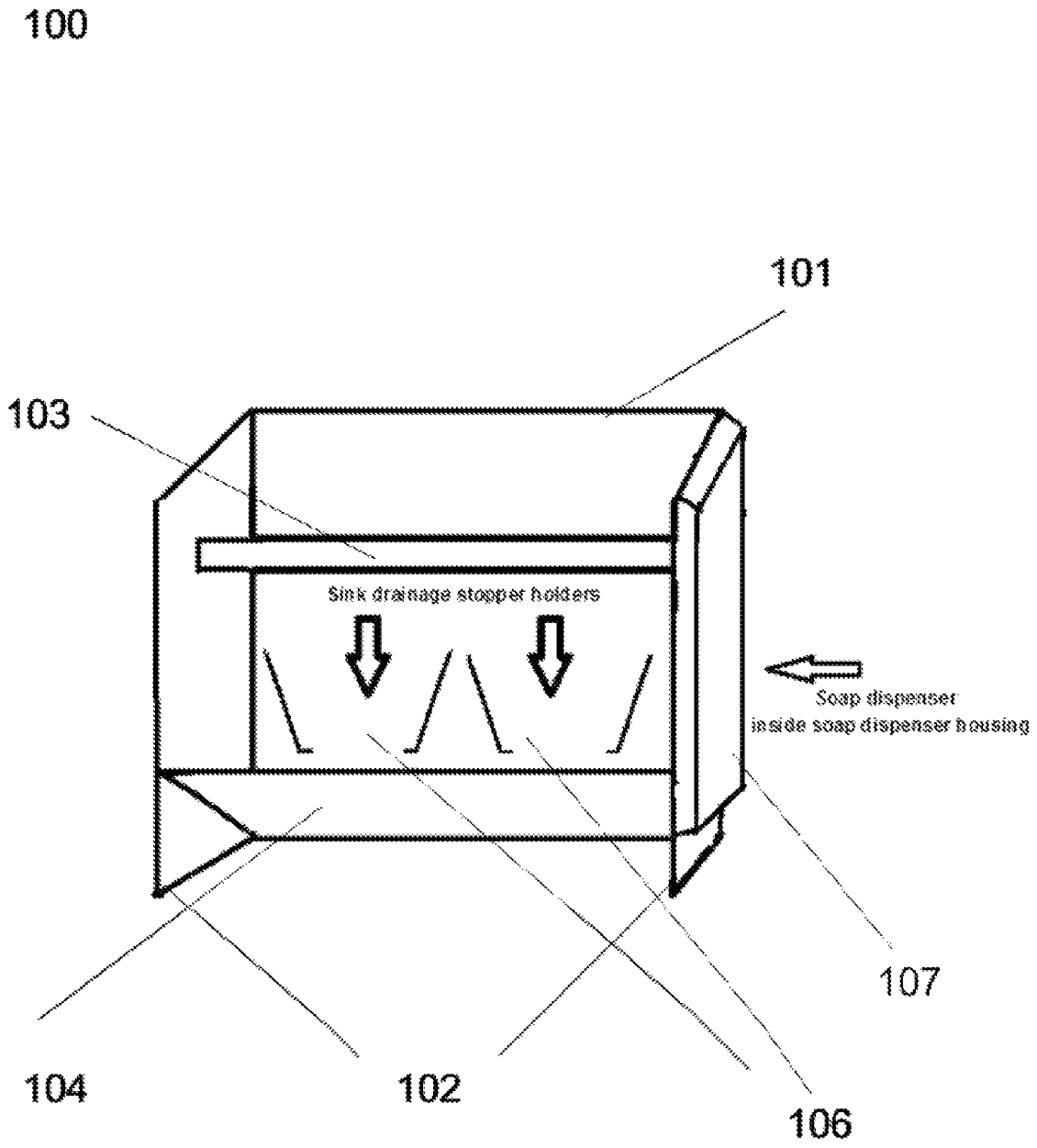
FIG. 8 shows a view of the backless holder from the rear with two partitioned sections designated for holding other sink items and a soap dispenser housing.

FIG. 8 illustrates the rear view of an embodiment of the holder 100, which also contains two partitioned sections 106 designated for holding other items to be drained and dried and dispenser 107. The rod 103 is connected between the two side covers 102. The drain panel 104 is also shown near the bottom of the holder. The partitioned sections 106 are located on the back of the front cover 101 inside the holder 100. The dispenser housing 107 is shown on the right side of the holder 100.

Figure 9:
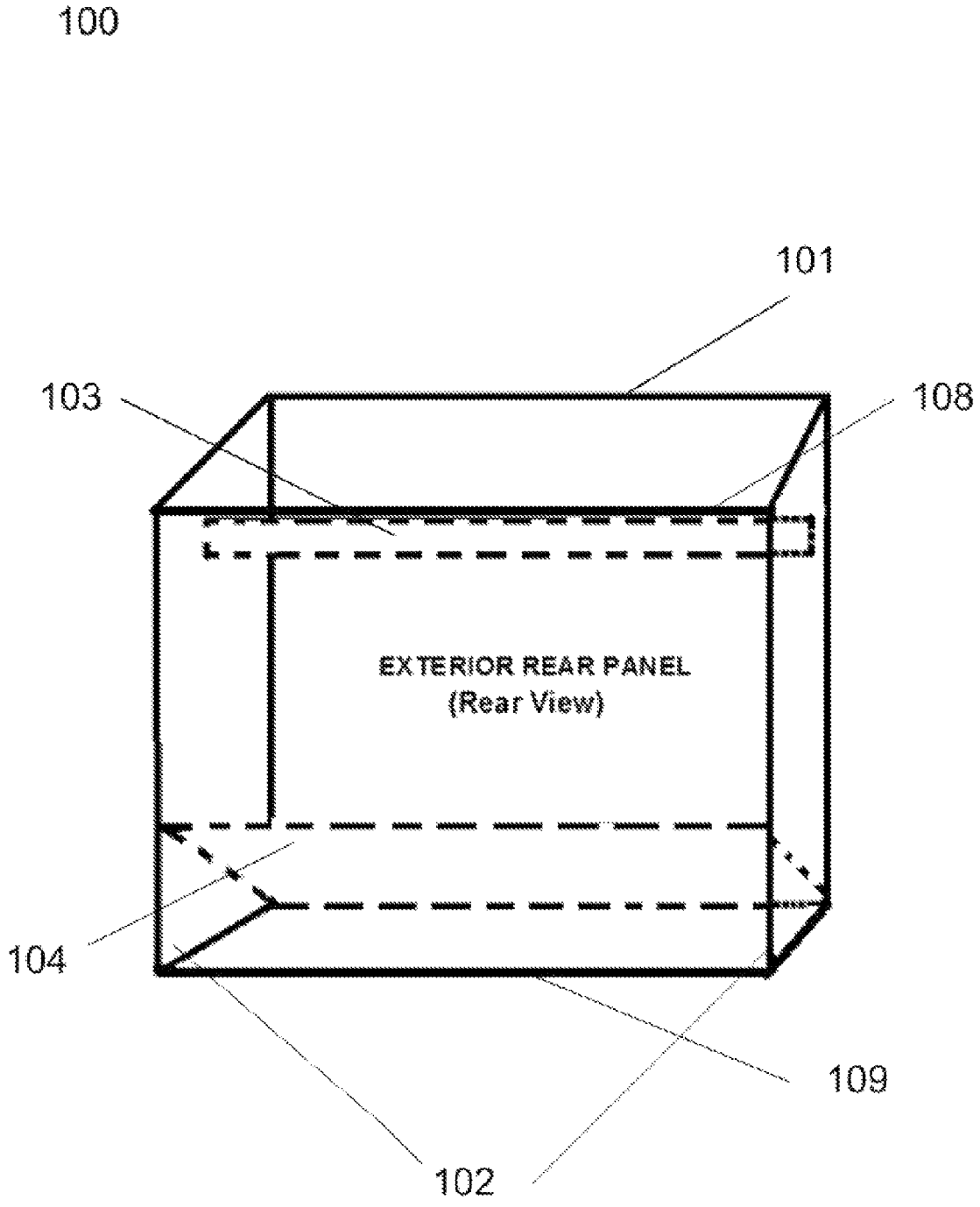
FIG. 9 shows a view of the holder, which includes a back cover, from the rear.

FIG. 9 illustrates an embodiment of the holder 100, with a back cover 108, from the rear view. This enclosed embodiment encloses the holder from all sides and keeps the items from the view in the kitchen, regardless of which side a person looks on. The interior of the holder is designated with dashed lines. The rod 103 is connected between the two side covers 102, and is shown near the top of the holder. The drain panel 104 is shown near the bottom of the holder. The back cover 108 can be identical to the front cover 101 in size and shape. In this embodiment, the bottom of the back cover 109 would have the same space between it and the counter as the bottom of the front cover 105. Alternatively, it can be the same length as the side covers 102, in which there would be no space between it and the counter.

Figure 10:
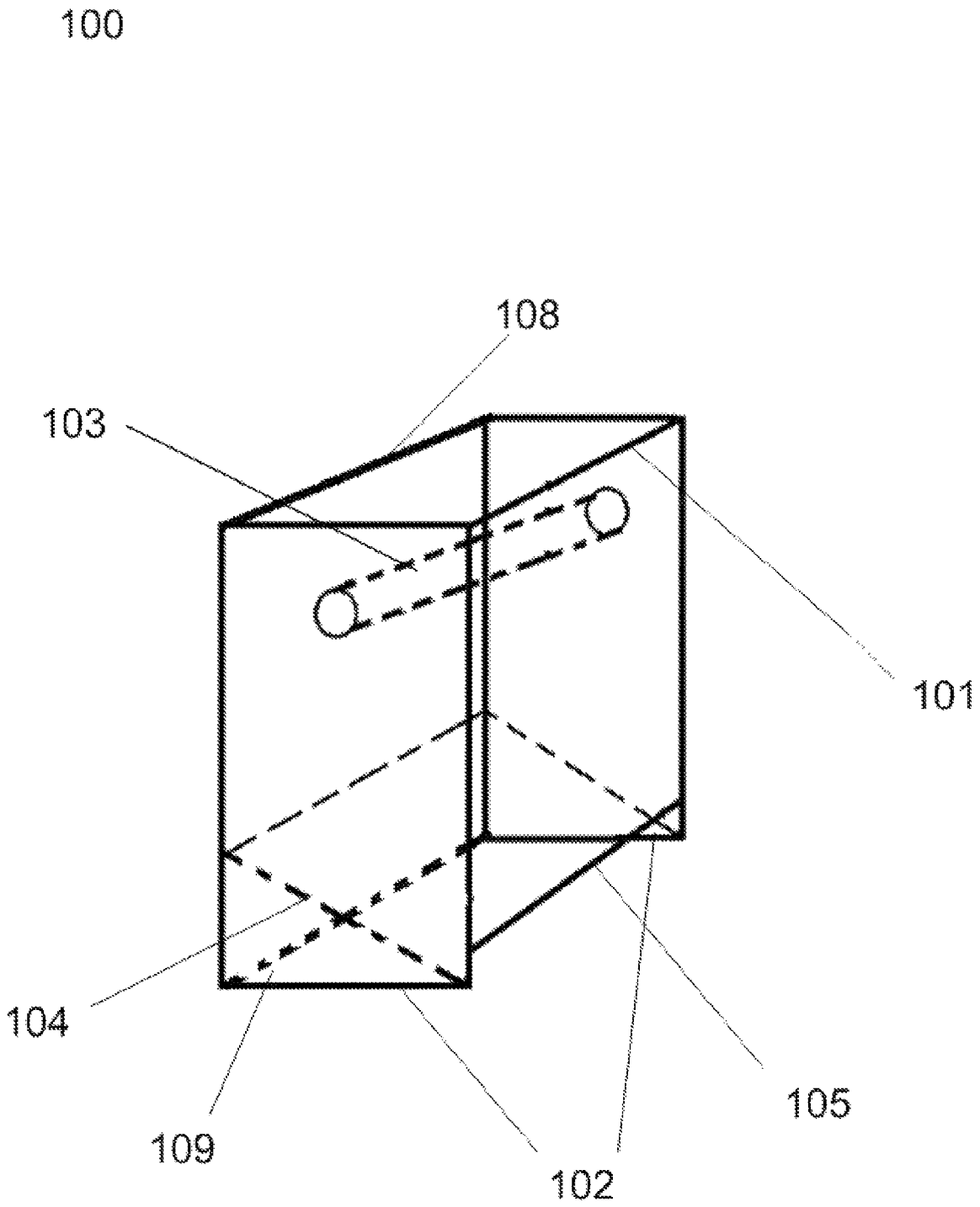
FIG. 10 shows a view of the holder, which includes a back cover, from the side.

FIG. 10 an embodiment of the holder 100, with a back cover 108, enclosing the holder on all sides, from the side view. The rod 103 is connected between the two side covers 102, and is shown near the top of the holder. The drain panel 104 is shown near the bottom of the holder, which allows excess liquid to drain under the bottom of the front cover 105. The bottom of the back cover 109, is shown at the bottom left portion of the holder and can either be the same size as the front cover 101 or the side covers 102.

Figure 11:
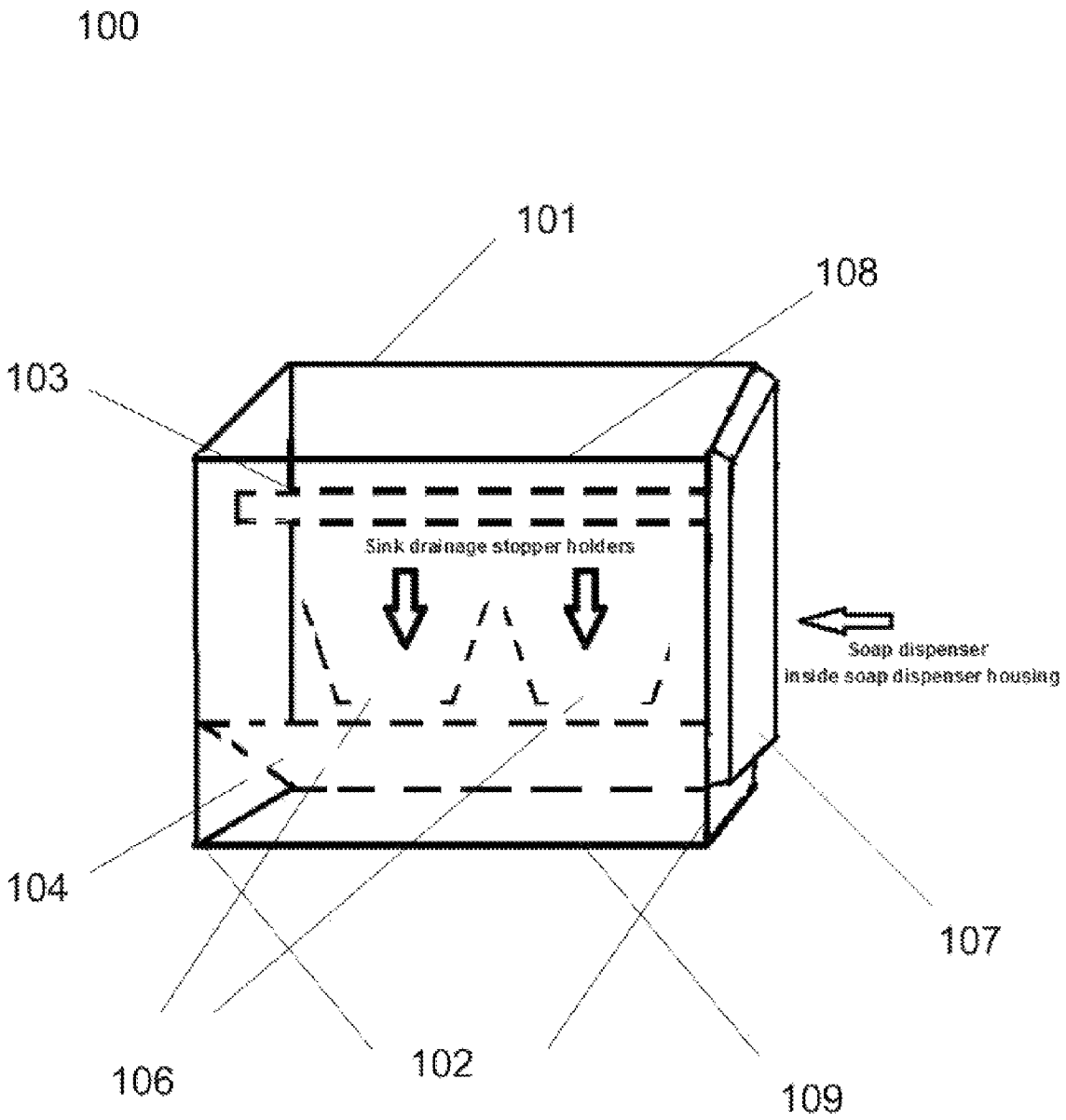
FIG. 11 shows a view of the holder, which includes a back cover, two partitioned sections designated for holding other sink items and a soap dispenser housing, from the rear.

FIG. 11 an embodiment of the holder 100, with a back cover 108, a dispenser housing, and two partitioned sections 106 designated for holding other items to be drained and dried, from the rear view. The rod 103 is connected between the two side covers 102, and is shown near the top of the holder. The drain panel 104 is shown near the bottom of the holder. The partitioned sections 106 are shown in the middle of the holder, which in this embodiment are the back of the front cover 101 inside the holder 100. The partitioned sections 106 are shown in the middle of the holder, which in this embodiment are the back of the front cover 101 inside the holder 100. The partitioned sections 106, which have an arrows pointing into each one, are located on the back of the front cover 101 inside the holder 100. The dispenser housing 107 is shown on the right side of the holder 100.

What is claimed:

1. A holder for drying a dish cloth and other sink items comprising:
- two side covers;
- at least one rod connected between said side covers;
- a front cover which is connected to said side covers and allows space for drainage under it;
- and a draining panel connected to said side covers, which is angled downward to allow drainage under said front cover.

2. The holder from claim 1, including a back cover.

3. The holder from claim 1, including a partitioned section inside the front cover of the holder, to hold items like stoppers, scrub pads, and other sink items.

4. The holder from claim 2, including a partitioned section inside the front cover of the holder, to hold items like stoppers, scrub pads, and other sink items.

5. The holder from claim 1, including partitioned sections inside the front cover of the holder, to hold items like stoppers, scrub pads, and other sink items.

6. The holder from claim 2, including partitioned sections inside the front cover of the holder, to hold items like stoppers, scrub pads, and other sink items.

7. A holder for drying a dish cloth and other sink items comprising:
- two side covers;
- at least one rod connected between said side covers;
- a front cover which is connected to said side covers and allows space for drainage under it;
- a draining panel connected to said side covers, which is angled downward to allow drainage under said front cover;
- and a separate compartment on a side cover that can be used as housing for a liquid soap dispenser.

8. The holder from claim 7, including a back cover.

9. The holder from claim 7, including a partitioned section inside the front cover of the holder, to hold items like stoppers, scrub pads, and other sink items.

10. The holder from claim 8, including a partitioned section inside the front cover of the holder, to hold items like stoppers, scrub pads, and other sink items.

11. The holder from claim 7, including partitioned sections inside the front cover of the holder, to hold items like stoppers, scrub pads, and other sink items.

12. The holder from claim 8, including partitioned sections inside the front cover of the holder, to hold items like stoppers, scrub pads, and other sink items.

13. A holder for drying a dish cloth and other sink items comprising:
- two side covers;
- at least one rod connected between said side covers;
- a front cover which is connected to said side covers and allows space for drainage under it;
- a top cover which is placed over the front and side covers;
- a draining panel connected to said side covers, which is angled downward to allow drainage under said front cover.

14. The holder from claim 13, including a back cover.

15. The holder from claim 13, including a separate compartment on a side cover that can he used as housing for a liquid soap dispenser.

16. The holder from claim 14, including a separate compartment on a side cover that can be used as housing for a liquid soap dispenser.

17. The holder from claim 13, including at least one partitioned section inside the front cover of the holder, to hold items like stoppers, scrub pads, and other sink items.

18. The holder from claim 14, including at least one partitioned section inside the front cover of the holder, to hold items like stoppers, scrub pads, and other sink items.

19. The holder from claim 15, including at least one partitioned section inside the front cover of the holder, to hold items like stoppers, scrub pads, and other sink items.

20. The holder from claim 16, including at least one partitioned section inside the front cover of the holder, to hold items like stoppers, scrub pads, and other sink items.

* * * * *